US006290583B1

(12) United States Patent
Suzuki et al.

(10) Patent No.: US 6,290,583 B1
(45) Date of Patent: Sep. 18, 2001

(54) APPARATUS FOR HOLDING WORKPIECE

(75) Inventors: Hiroo Suzuki; Seiji Ishikawa, both of Yokohama (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/150,371

(22) Filed: Sep. 10, 1998

(30) Foreign Application Priority Data

Sep. 10, 1997 (JP) ..... 9-262796

(51) Int. Cl.[7] ..... B24B 29/00
(52) U.S. Cl. ..... 451/288; 451/41; 285/14
(58) Field of Search ..... 451/288, 41; 285/41, 285/190, 279, 276, 14, 134

(56) References Cited

U.S. PATENT DOCUMENTS

| | | | | |
|---|---|---|---|---|
| 3,571,978 | | 3/1971 | Day et al. . | |
| 3,838,718 | * | 10/1974 | Flory et al. | 141/100 |
| 3,889,983 | * | 6/1975 | Freize et al. | 285/13 |
| 4,254,972 | * | 3/1981 | Wiedenbeck | 285/61 |
| 4,339,108 | * | 7/1982 | Daniluk | 251/58 |
| 4,360,186 | * | 11/1982 | Tinsley et al. | 251/1 B |
| 4,632,431 | * | 12/1986 | McCracken | 285/13 |
| 4,647,077 | * | 3/1987 | Ethridge et al. | 285/98 |
| 5,058,927 | * | 10/1991 | Miwa | 285/11 |
| 5,110,162 | * | 5/1992 | Peter et al. | 285/281 |
| 5,185,959 | * | 2/1993 | Ikola et al. | 51/72 R |
| 5,209,526 | * | 5/1993 | Beccia et al. | 285/134 |
| 5,303,959 | * | 4/1994 | Medsker | 285/24 |
| 5,443,416 | | 8/1995 | Volodarsky et al. . | |
| 5,643,053 | * | 7/1997 | Shendon | 451/28 |
| 5,653,476 | * | 8/1997 | Su et al. | 285/272.1 |
| 5,670,011 | * | 9/1997 | Togawa et al. | 156/345 |
| 5,738,574 | | 4/1998 | Tolles et al. . | |
| 5,747,386 | | 5/1998 | Moore . | |
| 5,820,448 | * | 10/1998 | Shamouilian et al. | 451/287 |
| 5,839,947 | * | 11/1998 | Kimura et al. | 451/288 |
| 6,024,633 | * | 2/2000 | Kimura et al. | 451/288 |

FOREIGN PATENT DOCUMENTS

| | | | | |
|---|---|---|---|---|
| 58-22657 | | 2/1983 | (JP) . | |
| 4-201174 | | 7/1992 | (JP) . | |
| 404203581 | * | 7/1992 | (JP) | 285/276 |

* cited by examiner

*Primary Examiner*—Eileen P. Morgan
*Assistant Examiner*—Hadi Shakeri
(74) *Attorney, Agent, or Firm*—Wenderoth, Lind & Ponack, L.L.P.

(57) ABSTRACT

An apparatus for holding a workpiece is incorporated in a polishing apparatus which polishes the workpiece to a flat mirror finish. The workpiece holding apparatus has a top ring holding a workpiece and a top ring drive shaft for rotating the top ring and pressing the top ring holding the workpiece against a turntable. A rotary joint is removably provided on the top ring drive shaft for allowing fluid to pass therethrough to thereby communicate with an external fluid source. A passage provided in the top ring drive shaft allows the rotary joint to communicate with through-holes formed in the top ring.

7 Claims, 4 Drawing Sheets

APPARATUS FOR HOLDING WORKPIECE

BACKGROUND OF THE INVENTION

1. Field of the Invention

The present invention relates to an apparatus for holding a workpiece, and more particularly to an apparatus for holding a workpiece such as a semiconductor wafer for use in a polishing apparatus which polishes the workpiece to a flat mirror finish.

2. Description of the Related Art

Recent rapid progress in semiconductor device integration demands smaller and smaller wiring patterns or interconnections and also narrower spaces between interconnections which connect active areas. One of the processes available for forming such interconnections is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus.

Conventionally, a polishing apparatus comprises a turntable having a polishing cloth thereon, a top ring for holding a workpiece such as a semiconductor wafer, a pressing device for pressing the workpiece held by the top ring against the polishing cloth on the turntable, and a driving device for rotating the top ring about its own axis. The top ring is coupled to the pressing device and the driving device through a top ring drive shaft. When the workpiece is transferred to the top ring, it is held by the lower surface of the top ring under vacuum developed in the top ring. When the workpiece is polished, a pressurized fluid such as compressed air is supplied from the top ring to the backside surface of the workpiece, thereby pressing a surface of the workpiece to be polished against a polishing surface comprising the polishing cloth on the turntable. Therefore, the top ring drive shaft coupled to the upper portion of the top ring is provided at its upper part with a rotary joint by which the top ring communicates with an external vacuum source or an external fluid source.

In the conventional polishing apparatus, the rotary joint is integrally formed with the top ring drive shaft. To be more specific, a lateral hole communicating with a vertical hole formed in the top ring drive shaft is formed in the upper part of the top ring drive shaft. By fixing the rotary joint incorporating the sealing portion therein to the top ring drive shaft, the lateral hole is caused to communicate with the connecting portion of the rotary joint which is connected to the external fluid source. Therefore, the conventional rotary-joint structure is problematic in that making the ring drive shaft is complicated and the replacement of the rotary joint is extremely troublesome when the sealing portion is damaged or worn.

Further, in the conventional rotary joint, the contacting surface between a stationary ring and a rotating ring serves as a sealing surface, and it is necessary to seal against a vacuum, pressurized air and pressurized liquid. In the case where the top ring communicates with the vacuum source through the rotary joint, a slurry-like abrasive liquid containing abrasive particles (or grains) is occasionally sucked up which then reaches, the sealing surface of the rotary joint. In this case, the abrasive liquid enters the sealing surface between the stationary ring and the rotating ring to thereby wear the sealing surface, and hence the sealing surface becomes irregular to cause fluid to leak therefrom.

Further, in the conventional rotary joint, fluid is prevented from leaking by a high contact pressure produced by making a spring force pressing the rotating ring and the stationary ring against each other larger. Therefore, the wear of the sealing surface progresses and the temperature rises in the sealing surface occurs, which causes thermal-stress cracking in either the stationary ring or the rotating ring.

SUMMARY OF THE INVENTION

It is therefore an object of the present invention to provide an apparatus for holding a workpiece in which a rotary joint can be attached to a top ring drive shaft without requiring a specific manufacturing operation for the top ring drive shaft, and can be easily replaced if the rotary joint is damaged or worn, by making the rotary joint a discrete unit.

Another object of the present invention is to provide an apparatus for holding a workpiece in which slurry can be prevented from entering a sealing surface of the rotary joint, and a temperature rise in the sealing surface can also be prevented from occurring to thereby avoid thermal-stress cracking in either a stationary ring or a rotating ring.

According to an aspect of the present invention, there is provided an apparatus for holding a workpiece comprising a top ring holding a workpiece, a top ring drive shaft for rotating the top ring and pressing the top ring holding the workpiece against a turntable, a rotary joint removably provided on the top ring drive shaft for allowing fluid to pass therethrough to thereby communicate with an external fluid source, and a passage provided in the top ring drive shaft for allowing the rotary joint to communicate with through-holes formed in the top ring.

According to the present invention, since the rotary joint is removably provided on the top ring drive shaft, it can be easily replaced with a new one if it is damaged or worn. Further, since the rotary joint is constructed as a discrete unit removable from the top ring drive shaft, a specific manufacturing operation for the top ring drive shaft, such as boring, is not required, thus reducing the manufacturing cost of the top ring drive shaft.

The rotary joint comprises a body, a stationary ring fixed to the body, a rotating ring housed in the body and rotated integrally with the top ring drive shaft, and a liquid supply hole formed in the body for supplying liquid to an outer circumferential portion of a contacting surface between the stationary ring and the rotating ring.

With the above structure, by supplying liquid such as pure water to the outer circumferential portion of the contacting surface between the stationary ring and the rotating ring, a sealing film of liquid is formed between the stationary ring and the rotating ring when a vacuum is developed. This sealing liquid prevents slurry such as an abrasive liquid from entering the contacting surface between the stationary ring and the rotating ring. Further, by supplying liquid to the contacting surface between the stationary ring a and the rotating ring, temperature rise generated by relative sliding movement of the stationary ring and the rotating ring can be suppressed to thus prevent thermal-stress cracking in either the rotating ring or the stationary ring.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENTS

An apparatus for holding a workpiece according to an embodiment of the present invention will be described below with reference to FIGS. 1 through 3.

Figure 1:
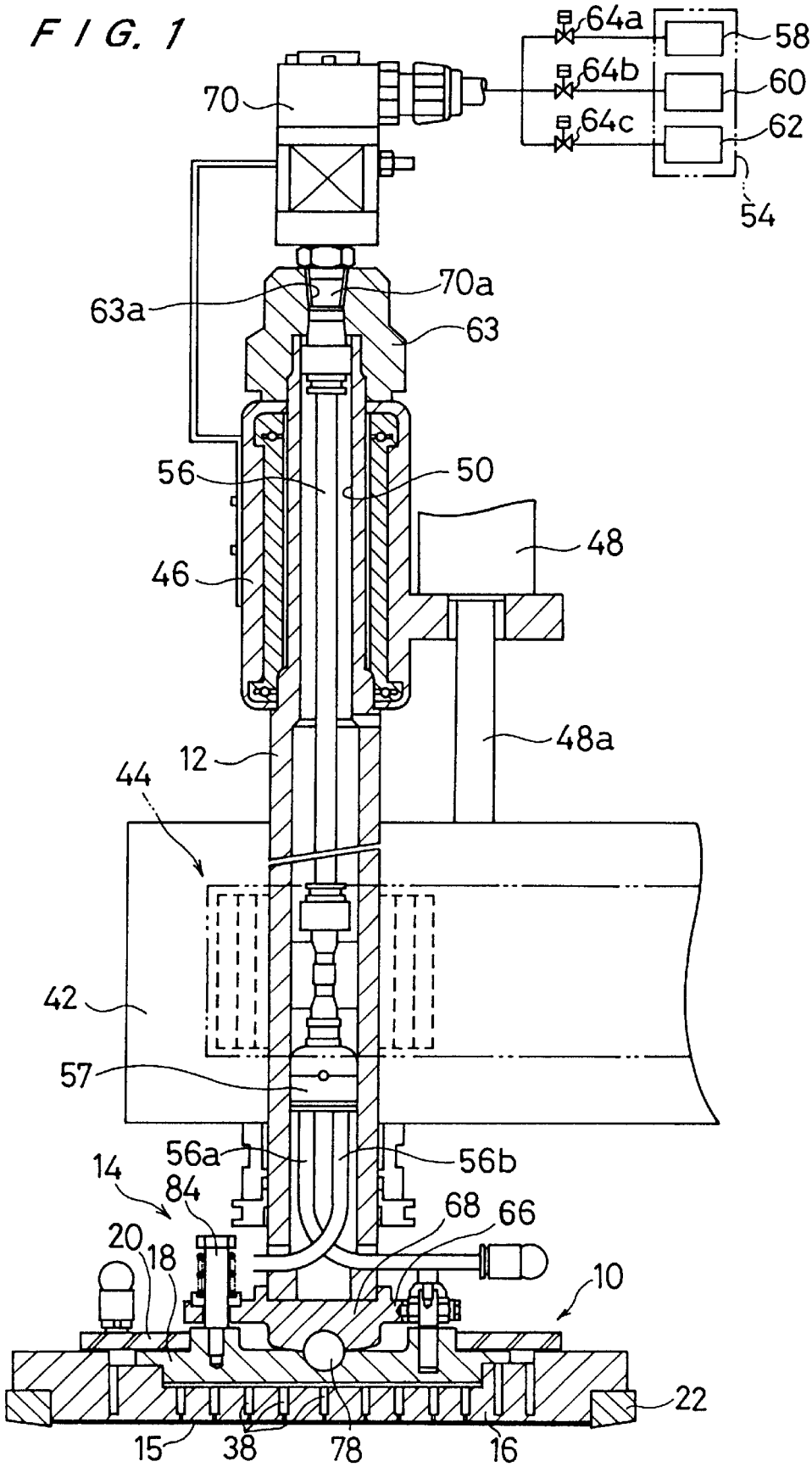
FIG. 1 is a vertical cross-sectional view showing an apparatus for holding a workpiece in a polishing apparatus according to an embodiment of the present invention.
Figure 2:
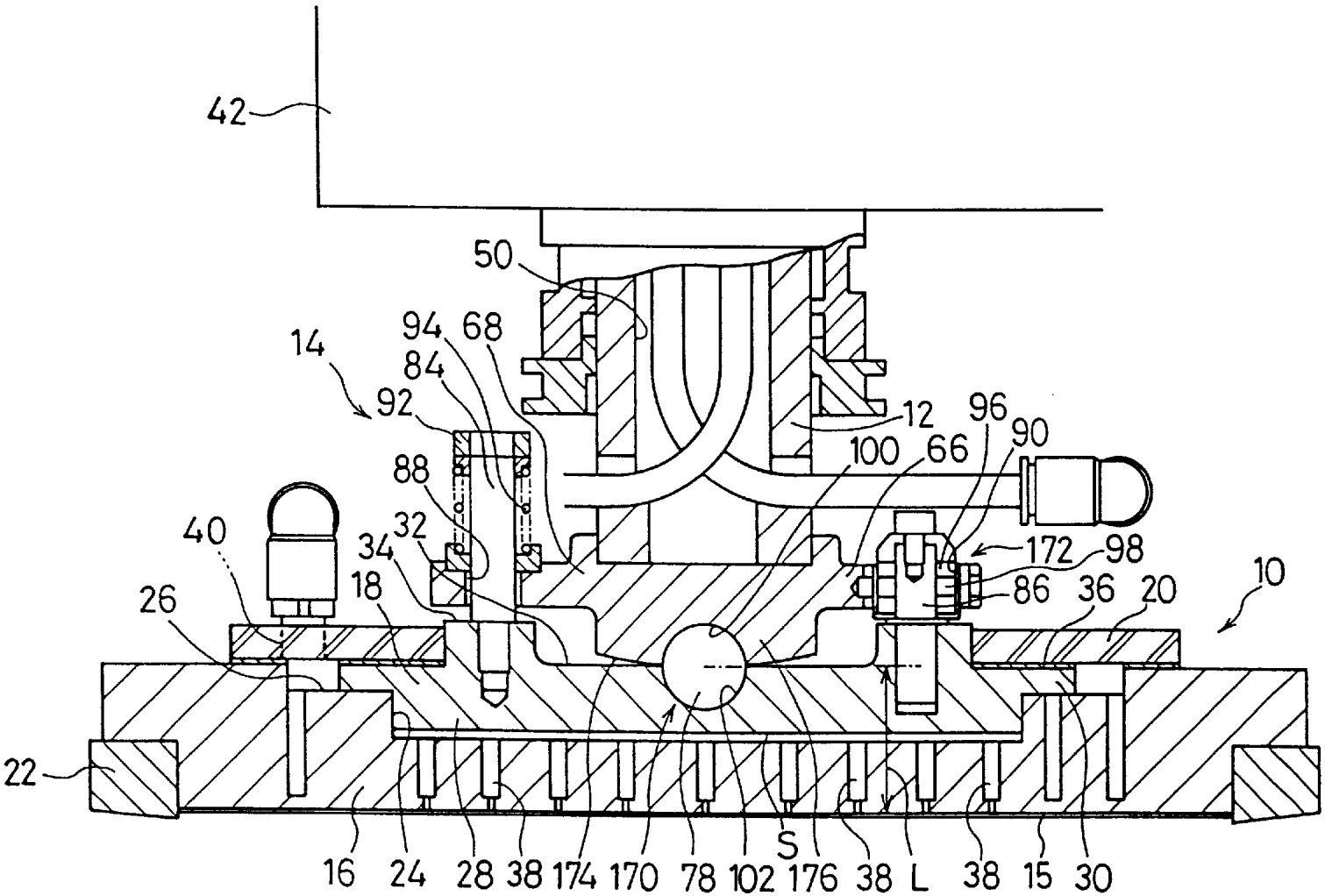
FIG. 2 is an enlarged fragmentary vertical cross-sectional view showing essential parts of the apparatus for holding the workpiece shown in FIG. 1.

As shown in FIGS. 1 and 2, an apparatus for holding a workpiece (hereinafter referred to as workpiece holding apparatus 1) comprises a substantially disk-like top ring 10, a top ring drive shaft 12 for supporting the top ring 10 and transmitting a rotating force and a pressing force to the top ring 10, and a universal joint unit 14 for coupling the top ring drive shaft 12 and the top ring 10 in such a manner that the top ring drive shaft 12 and the top ring 10 tilt relative to each other.

The top ring 10 comprises a substantially disk-like holding plate 16 for holding a semiconductor wafer (workpiece) to be polished at a lower surface thereof, a substantially disk-like cover plate 18 fixed to the holding plate 16 so as to define a gap S between the holding plate 16 and the cover plate 18, and an annular plate 20 for covering the holding plate 16 and the cover plate 18. A guide ring 22 is attached to the lower circumferential portion of the holding plate 16 for retaining a circumferential edge of the workpiece. An elastic pad 15 is attached to the lower surface of the holding plate 16.

The holding plate 16 has a recess 24 at an upper central part thereof, and a step 26 around the recess 24. The cover plate 18 has at its lower surface a projecting portion 28 which is fitted in the recess 24 of the holding plate 16. Further, the cover plate 18 has a flange 30, around the projecting portion 28, which is fixed to the step 26 of the holding plate 16 by bolts. The cover plate 18 has at its upper surface a recess 32 and an annular shoulder 34 around the recess 32, and a step outwardly of the shoulder 34 for attachment of the annular plate 20. The depth of the recess 24 of the holding plate 16 is larger than the height of the projecting portion 28 of the cover plate 18. Thus, the certain gap S is defined between the recess 24 and the projecting portion 28. The holding plate 16 has a number of through holes 38 which communicate with holes 40 formed in the annular plate 20 through the gap S between the cover plate 18 and the holding plate 16.

Further, the gap S communicates with the backside surface of the workpiece held by the lower surface of the holding plate 16 through the through holes 38. In the gap S, negative pressure or positive pressure is developed by allowing the gap S to communicate with a vacuum source or a pressurized fluid source. To be more specific, if the gap S communicates with the vacuum source, an attracting force is applied to the backside surface of the workpiece, and if the gap S communicates with the pressurized fluid source, a pressing force is applied to the backside surface of the workpiece.

The top ring drive shaft 12 is rotatably and vertically movably supported by a top ring head 42 which is supported by a frame of the polishing apparatus. That is, the top ring drive shaft 12 is coupled to an output shaft of a driving source (comprising a motor with reduction gears) provided on the top ring head 42 through a pully-belt mechanism 44 so as to be rotatable.

Further, the top ring drive shaft 12 is vertically movable by a top ring cylinder 48 provided between the top ring head 42 and a drive shaft holder 46. The top ring cylinder 48 is actuated by supplying air there to and discharging air there from. The body of the top ring cylinder 48 is fixed to the shoulder of the drive shaft holder 46, and the forward end of the rod 48*a* is fixed to the upper surface of the top ring head 42.

The top ring drive shaft 12 is a hollow cylindrical member, and has at its central part a vertical hole 50 which communicates with an external fluid source 54 through a rotary joint 70. In the vertical hole 50, there is provided a tube 56 made of synthetic resin having corrosion resistance such as Teflon (the trade name of polytetrafluoroethylene) or polypropylene. The upper end of the tube 56 is connected to the rotary joint 70, and the lower end of the tube 56 is branched into two tubes 56*a*, 56*b* through a branch connection 57. The tubes 56*a*, 56*b* communicate with the holes 40 of the annular plate 20.

The rotary joint 70 has at its lower end a screw 70*a* which is threaded into a thread 63*a* of a member 63 fixed to the upper end of the top ring drive shaft 12. That is, the rotary joint 70 is fixed to the top ring drive shaft 12 by the screw engagement, and hence mounting or dismounting of the rotary joint 70 can be easily performed, and the replacement of the rotary joint 70 can be easily performed if it is damaged or worn. Further, since the rotary joint 70 is a discrete unit which is separable from the top ring drive shaft 12, a lateral hole communicating with the vertical hole 50 is not required to be formed in the top ring drive shaft 12 and the manufacture of the top ring drive shaft 12 can be easily conducted.

The external fluid source 54 comprises a vacuum source 58, a pressurized air source 60 and a pure water supply source 62 which can selectably communicate with the through holes 38 of the holding plate 16 through selective control valves 64*a* through 64*c*, the rotary joint 70, the tube 56, and the tubes 56*a*, 56*b*.

Figure 3:
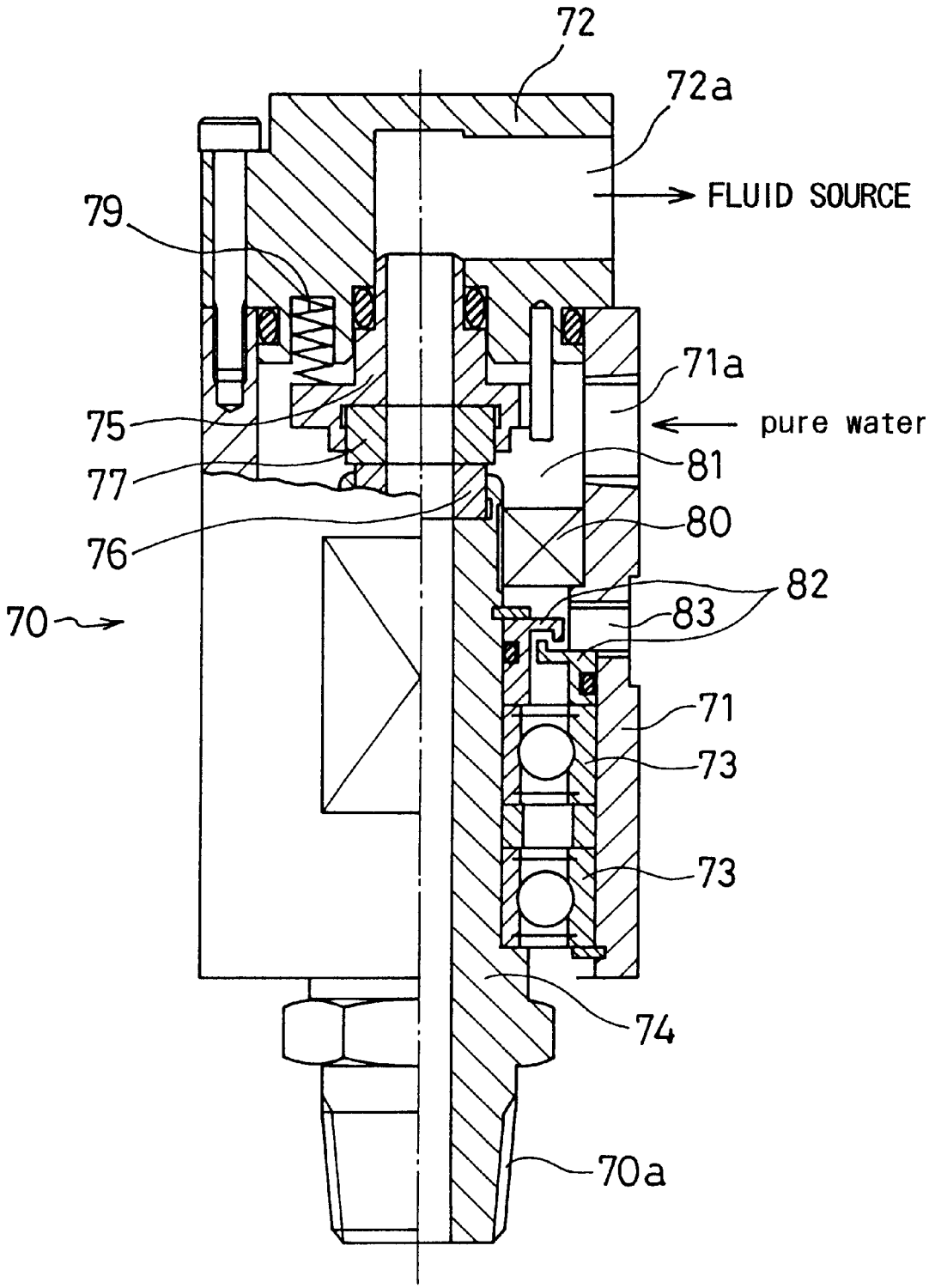
FIG. 3 is a vertical cross-sectional view of a rotary joint in the apparatus for holding the workpiece shown in FIG. 1.

FIG. 3 is a front view partly in section showing the detailed structure of the rotary joint 70. As shown in FIG. 3, the rotary joint 70 comprises a lower body 71, an upper body 72 fixed to the lower body 71, a hollow rotating shaft 74 supported by ball bearings 73, 73 provided in the lower body 71, and a hollow stationary shaft 75 fixed to the upper body 72. The upper body 72 has a part 72*a* through which fluid is supplied to the rotary joint 70 or discharged from the rotary joint 70.

A rotating ring 76 made of ceramics such as silicon carbide (SiC) is fixed to the upper end of the rotating shaft 74. The rotating shaft 74 has at its lower end the screw 70*a* which is threaded into the top ring drive shaft 12. A stationary ring 77 made of ceramics such silicon carbide (SiC) is fixed to the lower end of the stationary shaft 75. The stationary ring 77 is brought into sliding contact with the rotating ring 76. The stationary ring 77 is pressed against the rotating ring 76 by a compression coil spring 79 to cause the stationary ring 77 to normally contact the rotary ring 76. That is, the rotating ring 76 and the stationary ring 77 allow fluid to pass therethrough to thereby supply fluid between the rotating part and the stationary part and constitute a sealing surface which prevents fluid from leaking externally.

An oil seal 80 is provided around the upper circumferential portion of the rotating shaft 74, and pure water is supplied to a space 81 defined above the oil seal 80 through a pure water supply hole 71*a* formed in the lower body 71. Therefore, it is possible to supply pure water to the outer circumferential portion of the sealing surface between the rotating ring 76 and the stationary ring 77. A water expulsion mechanism 82 comprising upper and lower rings is provided between the oil seal 80 and the ball bearing 73 to prevent liquid such as pure water from entering the ball bearing 73. That is, the water expulsion mechanism 82 constitutes a leakage-prevention section which prevents liquid from entering the ball bearing 73. The reference numeral 83 represents a drain hole which serves to discharge leakage liquid from the oil seal 80 to the exterior of the rotary joint 72.

As shown in FIGS. 1 and 2, a driving plate 68 having a flange 66 extending outwardly is fixed to the lower end of the top ring drive shaft 12. The universal joint unit 14 is provided between the driving plate 68 and the cover plate 18 of the top ring 10 so that the top ring 10 is tiltably supported by the top ring drive shaft 12 and the pressing force is transmitted from the top ring drive shaft 12 to the top ring 10. The universal joint unit 14 comprises a spherical bearing mechanism 170 and a rotation transmission mechanism 172 for transmitting the rotation of the top ring drive shaft 12 to the top ring 10.

The spherical bearing mechanism 170 comprises a central spherical concave surface 100 formed in the lower end of the projecting portion 176 of the driving plate 68, a central spherical concave surface 102 formed in the upper end of the cover plate 18, and a ball 78 made of high hardness material such as ceramics interposed between the spherical concave surfaces 100 and 102. A plurality of pins 84 and 86 (six in this embodiment) that extend upwardly are provided at equal angular intervals on the shoulder 34 of the cover plate 18, and these pins 84 and 86 are inserted into holes 88 and 90 formed in the flange 66 of the driving plate 68. The pins 84 serve to lift the top ring 10 and these pins 86 serve to transmit rotation of the top ring drive shaft 12 to the top ring 10. The pin 84 projects from the upper surface of the driving plate 68, and a compression coil spring 94 is provided between a stopper 92 of the pin 84 and the driving plate 68 to support a part of weight of the top ring 10 by the resilient force of the spring 94. Two parallel pins 98 extending horizontally are provided in the flange 66 so as to sandwich the pin 86. In this case, even if the holding plate 16 is inclined, since the driven pin 86 and the driving pins 98 are relatively vertically movable, the torque of the top ring drive shaft 12 can be reliably transmitted to the holding plate 16 with movement of the contacting point of the pins 86 and 98.

Figure 4:
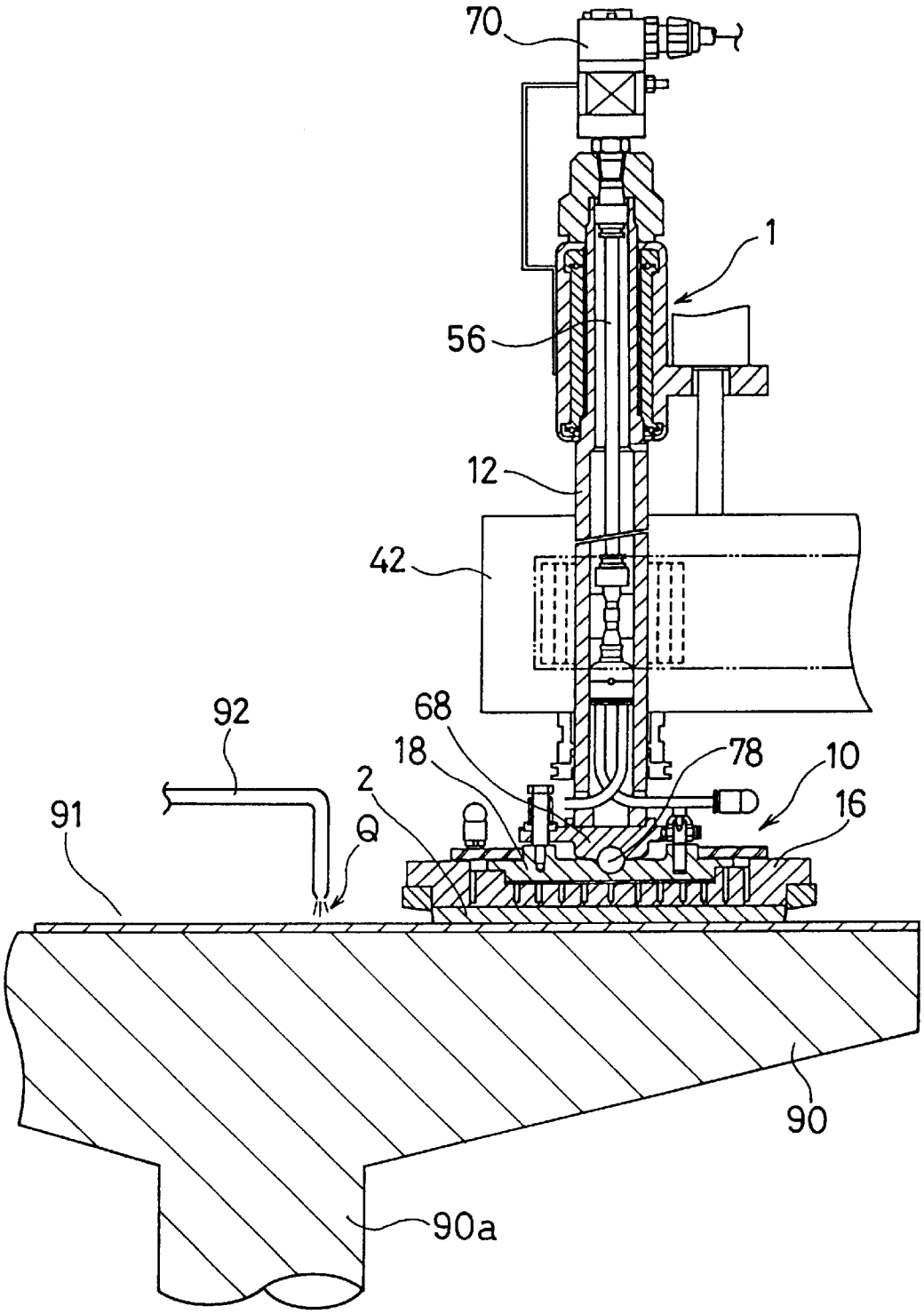
FIG. 4 is a cross-sectional view showing the whole structure of the polishing apparatus according to an embodiment of the present invention.

FIG. 4 shows the polishing apparatus which incorporates the workpiece holding apparatus 1 shown in FIGS. 1 through 3. As shown in FIG. 4, a turntable 90 is supported on a central shaft 90*a* and is rotatable about the axis of the shaft 90*a*. A polishing cloth 91 is attached to the upper surface of the turntable 90. The workpiece holding apparatus 1 holding a semiconductor wafer 2 is disposed above the turntable 90. An abrasive liquid supply nozzle 92 is disposed above the turntable 90 so that an abrasive liquid Q containing abrasive material can be supplied to the polishing cloth 91 on the turntable 90.

Next, the operation of the polishing apparatus incorporating the workpiece holding apparatus 1 shown in FIGS. 1 through 4 will be described.

The tube 56 in the top ring drive shaft 12 communicates with the vacuum source 58 of the external fluid source 54 through the rotary joint 70, and hence the semiconductor wafer 2 is held by the lower surface of the holding plate 16 under vacuum developed in the through holes 38 of the holding plate 16. The driving source is energized, and the top ring drive shaft 12 is rotated to thus rotate the holding plate 16. In this case, the tube 56 made of Teflon or polypropylene has a strength such that it is hardly deformed when it communicates with the vacuum source 58.

The semiconductor wafer 2 is held by the top ring 10, and pressed against the polishing cloth 91 on the turntable 90 by the top ring cylinder 48. At this time, the turntable 90 is being rotated, and the top ring 10 is also being rotated to thus produce the relative motion between the semiconductor wafer 2 and the polishing cloth 91. Further, the abrasive liquid Q is supplied from the abrasive liquid supply nozzle 92 onto the polishing cloth 91. The supplied abrasive liquid Q is retained on the polishing cloth 91, and the semiconductor wafer 2 is polished in contact with the polishing cloth 91. During polishing, by allowing the tube 56 in the top ring drive shaft 12 to communicate with the pressurized air source 60 of the fluid source 54 through the rotary joint 70, the pressurized air is supplied to the backside surface of the semiconductor wafer 2 through the through holes 38, whereby the semiconductor wafer 2 is pressed against the polishing cloth 91.

In this case, the pressing force of the top ring drive shaft 12 is transmitted to the top ring 10 through the spherical bearing mechanism 170. When the upper surface of the turntable 90 is slightly tilted during polishing of the semiconductor wafer, the holding plate 16 is tilted about the ball 78 with respect to the top ring drive shaft 12 to thereby bring the en-tire surface of the semiconductor wafer 2 in close contact with the polishing surface of the turntable 90.

After completing polishing of the semiconductor wafer, the top ring drive shaft 12 is lifted to raise the top ring 10, and then the top ring 10 is moved away from the turntable 90 and positioned above a transfer device for transferring the semiconductor wafer from or to the top ring 10. At this time, the semiconductor wafer 2 is held by the lower surface of the holding plate 16 under vacuum by causing the tube 56 in the top ring drive shaft 12 to communicate with the vacuum source 58 through the rotary joint 70. Thereafter, the communication between the tube 56 and the vacuum source 58 is stopped, and the tube 56 communicates with the pure water supply source 62 through the rotary joint 70. Thus, the semiconductor wafer 2 is easily removed from the holding plate 16 because the pure water supplied through the tube 56, the gap S and the through holes 38 of the holding plate 16 pushes the backside surface of the semiconductor wafer 2.

According to the embodiment of the present invention, the rotary joint 70 is constructed as a discrete unit removable from the top ring drive shaft 12, and is fixed to the upper end of the top ring drive shaft 12 through the screw engagement. Therefore, the mounting or dismounting of the rotary joint 70 can be easily performed, and the rotary joint 70 can be easily replaced with a new one if it is damaged or worn. Further, the rotary joint 70 can be mounted or dismounted in an axial direction of the top ring drive shaft 12, thereby facilitating the replacement work. Further, it is unnecessary to form a lateral hole which communicates with the vertical hole 50 in the top ring drive shaft 12, and hence the work of the top ring drive shaft 12 is extremely simple.

Further, according to the embodiment of the present invention, by supplying pure water to the outer circumferential portion of the sealing surface of the rotary joint 70, i.e., the outer circumferential portion of the rotating ring 76 and the stationary ring 77, a sealing film is formed between the rotating ring 76 and the stationary ring 77 when a vacuum is developed in the sealing surface of the both rings 76 and 77. This sealing film of pure water prevents a slurry such as an abrasive liquid from entering the sealing surface of the rotary joint 70. Further, by supplying pure water to the outer circumferential portion of the sealing surface, a temperature rise caused by frictional heat between the rotating ring 76 and the stationary ring 77 can be suppressed to thus prevent thermal-stress cracking in either the rotating ring 76 or the stationary ring 77. By providing the water expulsion mechanism 82 above the ball bearing 73, liquid leaking from the sealing surface is prevented from entering the interior of the ball bearing 73 to thus prevent the bearing 73 from being damaged.

Further, according to the embodiment of the present invention, by suitably arranging the outer diameters of the rotating ring 76 and the stationary ring 77, depending on the property or pressure of fluid, the sealing surface of the rotary joint 70 can have an optimum pressure balancing diameter, and hence an excessive pressure is not applied by the spring 79 to the sealing surface of the rotary joint 70. Therefore, the wear of the sealing surface can be reduced to a minimum, and the temperature rise of the sealing surface can also be prevented. Since the tube 56 connected to the rotary joint 70 is made of a corrosion-resistant material, even if air and water are allowed to pass therethrough alternately, the generation of rust is prevented in the tube 56. Thus, fluid is not contaminated by rust, and hence the polishing performance and quality of the polished semiconductor wafer are improved.

Although certain preferred embodiments of the present invention have been shown and described in detail, it should be understood that various changes and modifications may be made therein without departing from the scope of the appended claims.

What is claimed is:

1. An apparatus for holding a workpiece comprising:

a top ring holding a workpiece;

a top ring drive shaft for rotating said top ring;

a rotary joint provided on said top ring drive shaft for allowing fluid to pass therethrough to thereby communicate with an external fluid source; and a passage provided in said top ring drive shaft to allow said rotary joint to communicate with said top ring;

wherein said rotary joint comprises a body, a stationary part provided in said body, a rotating part housed in said body, being rotated with said top ring drive shaft, and being in sliding contact with said stationary part such that there is a contacting surface between said stationary part and said rotating part, and a liquid supply hole formed in said body for supplying liquid to an outer circumferential portion of said contacting surface.

2. An apparatus according to claim 1, wherein said rotary joint is mounted on said top ring drive shaft by a screw engagement.

3. An apparatus according to claim 1, wherein said passage comprises a tube made of corrosion-resistant material.

4. An apparatus according to claim 1, wherein said external fluid source comprises at least one of a vacuum source, a pressurized air source and a liquid supply source.

5. An apparatus for holding a workpiece comprising:

top ring holding a workpiece;

a top ring drive shaft for rotating said top ring;

a rotary joint provided on said top ring drive shaft for allowing fluid to pass therethrough to thereby communicate with an external fluid source; and a passage provided in said top ring drive shaft to allow said rotary joint to communicate with said top ring;

wherein said rotary joint comprises a body, a stationary part provided in said body, a rotating part housed in said body, being rotated with said top ring drive shaft, and being in sliding contact with said stationary part, a bearing for rotatably supporting said rotating part, a sealing section between said rotating part and said body, and a leakage-prevention section between said sealing section and said bearing for preventing liquid from entering said bearing.

6. A polishing apparatus for polishing a surface of a workpiece comprising:

a turntable having a polishing surface thereon;

a top ring holding a workpiece;

a top ring drive shaft for rotating said top ring;

a rotary joint provided on said top ring drive shaft for allowing fluid to pass therethrough to thereby communicate with an external fluid source; and a passage provided in said top ring drive shaft to allow said rotary joint to communicate with said top ring;

wherein said rotary joint comprises a body, a stationary part provided in said body, a rotating part housed in said body, being rotated with said top ring drive shaft, and being in sliding contact with said stationary part such that there is a contacting surface between said stationary part and said rotating part, and a liquid supply hole formed in said body for supplying liquid to an outer circumferential portion of said contacting surface.

7. A polishing apparatus for polishing a surface of a workpiece comprising:

a turntable having a polishing surface thereon;

a top ring holding a workpiece;

a top ring drive shaft for rotating said top ring;

a rotary joint provided on said top ring drive shaft for allowing fluid to pass therethrough to thereby communicate with an external fluid source; and a passage provided in said top ring drive shaft to allow said rotary joint to communicate with said top ring;

wherein said rotary joint comprises a body, a stationary part provided in said body, a rotating part housed in said body, being rotated with said top ring drive shaft, and being in sliding contact with said stationary part, a bearing for rotatably supporting said rotating part, a sealing section between said rotating part and said body, and a leakage-prevention section between said sealing section and said bearing for preventing liquid from entering said bearing.

* * * * *

UNITED STATES PATENT AND TRADEMARK OFFICE

CERTIFICATE OF CORRECTION

PATENT NO. : 6,290,583 B1
DATED : September 18, 2001
INVENTOR(S) : Hiroo Suzuki et al.

It is certified that error appears in the above-identified patent and that said Letters Patent is hereby corrected as shown below:

Column 8,
Line 2, please change "top ring holding a workpiece;" to -- a top ring holding a workpiece; --.

Signed and Sealed this

Thirtieth Day of April, 2002

*Attest:*

*Attesting Officer*

JAMES E. ROGAN
*Director of the United States Patent and Trademark Office*